US005803753A

United States Patent [19]

Fukuda

[11] Patent Number: 5,803,753

[45] Date of Patent: Sep. 8, 1998

[54] TERMINAL ARRANGING BOARD FOR A CIRCUIT BOARD CONNECTOR

[75] Inventor: Eiji Fukuda, Shizuoka, Japan

[73] Assignee: Yazaki Corporation, Tokyo, Japan

[21] Appl. No.: 852,053

[22] Filed: May 6, 1997

Related U.S. Application Data

[63] Continuation of Ser. No. 450,850, May 25, 1995, abandoned.

[30] Foreign Application Priority Data

May 30, 1994 [JP] Japan ..... 6-117099

[51] Int. Cl.[6] ..... H01R 9/09

[52] U.S. Cl. ..... 439/79

[58] Field of Search ..... 439/79, 381

[56] References Cited

FOREIGN PATENT DOCUMENTS 3402902 8/1985 Germany .

4018947 1/1992 Germany .

59-194287 12/1984 Japan .

60-98280 7/1985 Japan .

62-17252 2/1987 Japan .

*Primary Examiner*—Gary F. Paumen

*Attorney, Agent, or Firm*—Sughrue, Mion, Zinn, Macpeak & Seas, PLLC

[57] ABSTRACT

For a circuit board connector comprising a connector housing, and connecting terminals which are bent at right angles and led out of the connector housing, a terminal arranging board is provided which includes: a terminal arranging section having a plurality of terminal inserting holes; and a lock arm section having a pair of flexible engaging pieces which are extended from the front end of the terminal arranging section in such a manner as to confront with each other. The outer side portion of at least one of the engaging pieces of the lock arm section is formed into an expanded portion having a tapered surface. The distance between the outer side faces of the engaging pieces is larger than the width of an engaging recess formed in the connector housing.

7 Claims, 5 Drawing Sheets

TERMINAL ARRANGING BOARD FOR A CIRCUIT BOARD CONNECTOR

This is a Continuation of application Ser. No. 08/450,850 filed May 25, 1995, now abandoned.

BACKGROUND OF THE INVENTION

1. Field of the Invention

This invention relates to a board for arranging the terminals of a connector, and more particularly to a board for arranging the terminals of a circuit board connector (hereinafter referred to as "a terminal arranging board", when applicable) which is coupled to a circuit board connector mounted on a printed circuit board to align a plurality of connecting terminals led out of the connector housing.

2. Related art

In general, a circuit board connector connected to a printed circuit board is designed as follows: In order to hold the circuit board connector horizontal when mounted on the printed circuit board, the connecting terminals led out of the connector housing are bent at right angles and then inserted into connecting holes formed in the printed circuit board.

As the number of connecting terminals increases, it is difficult to maintain the intervals of the terminals in correspondence to those of the connecting holes of the printed circuit board. Hence, in mounting the circuit board connector on the printed circuit board, it is necessary to adjust the intervals of the terminals according to the intervals of the connecting holes. This takes a lot of time and labor.

In order to achieve the connection of the circuit board connector to the printed circuit board with high efficiency, a terminal arranging board is employed which has been disclosed, for instance, by Unexamined Japanese Utility Model (OPI) No. 194287/1984.

As shown in FIG. 7, a connector body 31 substantially in the form of a rectangular box has right and left walls in which through-holes, namely, engaging holes 38 are formed, respectively. Connecting pins 33 bent at right angles extend outside through the upper opening of the connector body 31. A pin guide 32 has inserting holes 35 into which the connecting pins 33 are inserted; and a pair of elastic legs 39 and 39 each having a protrusion 37 at the end.

The pin guide 32 is coupled to the connector body 31 as follows: The pin guide 32 is set near the connector body 31. Under this condition, while the connecting pins 33 are being inserted into the inserting holes 35, the elastic legs 39 and 39 are pushed in between the right and left walls of the connector body. As a result, the elastic legs 39 and 39 are elastically deformed, so that the protrusions 37 are engaged with the engaging holes 38 respectively, and the elastic legs 39 are restored. Thus, the pin guide 32 has been coupled to the connector body 31.

The pin guide 32 designed as described above is advantageous in that it is not easily disengaged from the connector housing even when vibrated during transportation, and it can be instantly engaged with the connector housing. However, the pin guide 32 is disadvantageous in the following points: When the pin guide 32 has been engaged with the connector body 31, the end portions of the protrusions 37 protrude outside through the engaging holes 38 and are exposed. Hence, if external force is applied to the protrusion 37 during transportation, then it may be readily disengaged from the engaging hole 38.

SUMMARY OF THE INVENTION

Accordingly, an object of the invention is to eliminate the above-described difficulties accompanying a conventional terminal arranging board. More specifically, an object of the invention is to provide a terminal arranging board which is positively prevented from moving in the connector housing or coming off the connector housing.

The foregoing object of the invention has been achieved by the provision of a terminal arranging board for a circuit board connector which is coupled to a connector housing and aligns a plurality of connecting terminals led out of the connector housing, and comprises: a terminal arranging section having a plurality of terminal inserting holes; a lock arm section which is extended from the terminal arranging section, and a pair of flexible engaging pieces which are engaged with an engaging recess formed in the connector housing, wherein the outer side portion of at least one of the engaging pieces of the lock arm section is formed into an expanded portion having a tapered surface, so that, when the terminal arranging board is coupled to the connector housing, the engaging pieces are pushed against the side surfaces of the engaging recess.

In addition, in the terminal arranging board, the distance between the outer side faces of the engaging pieces is larger than the width of the engaging recess formed in the connector housing.

In the terminal arranging board according to the invention, the outer side portion of at least one of the engaging pieces of the lock arm section is formed into the expanded portion having the tapered surface. Hence, when the terminal arranging board is coupled to the connector housing, the engaging piece is pushed into the engaging recess of the connector housing while being elastically deformed, so that the lock arm section including the expanded portion is locked in place in the engaging recess.

In this connection, the width of the engaging recess is smaller than the distance between the outer side faces of the engaging pieces of the lock arm section, and therefore when the lock arm section is engaged with the engaging recess formed in the connector housing, the engaging pieces are held elastically deformed.

Hence, the restoring force of the engaging pieces acts outwardly to cause the engaging pieces to push the side surfaces of the engaging recess, while the component of the restoring force acts longitudinally of the terminal arranging board to press the latter against the connector housing. In other words, when the terminal arranging board is coupled to the connector housing, the engaging pieces of the lock arm section are pushed against the side surfaces of the engaging recess formed in the connector housing, so that the terminal arranging board is pushed, as a whole, against the connector housing, whereby the terminal arranging board is locked to the connector housing with no play while aligning the connecting terminals.

DETAILED DESCRIPTION OF THE PREFERRED EMBODIMENTS

Figure 1:
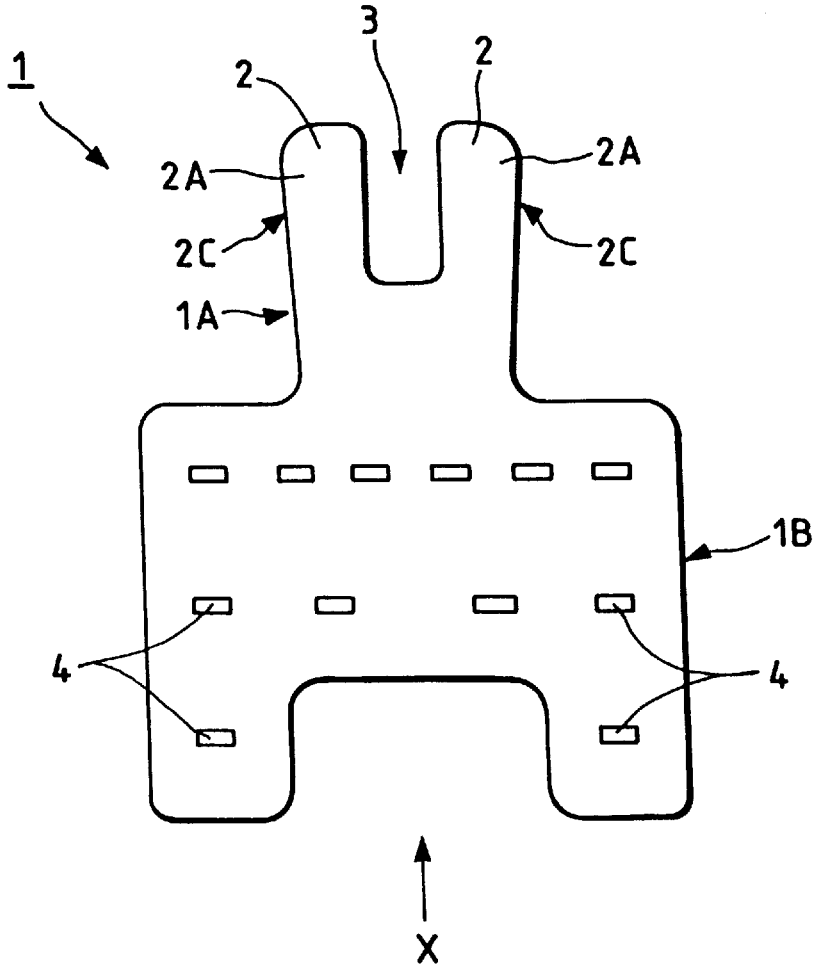
FIG. 1 is a plan view showing an example of a terminal arranging board for a circuit board connector according to a second embodiment of the present invention.
Figure 2:
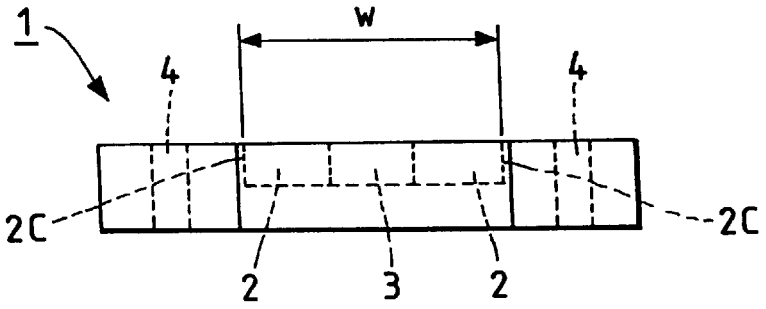
FIG. 2 is a view taken in the direction of the arrow X in FIG. 1.
Figure 3:
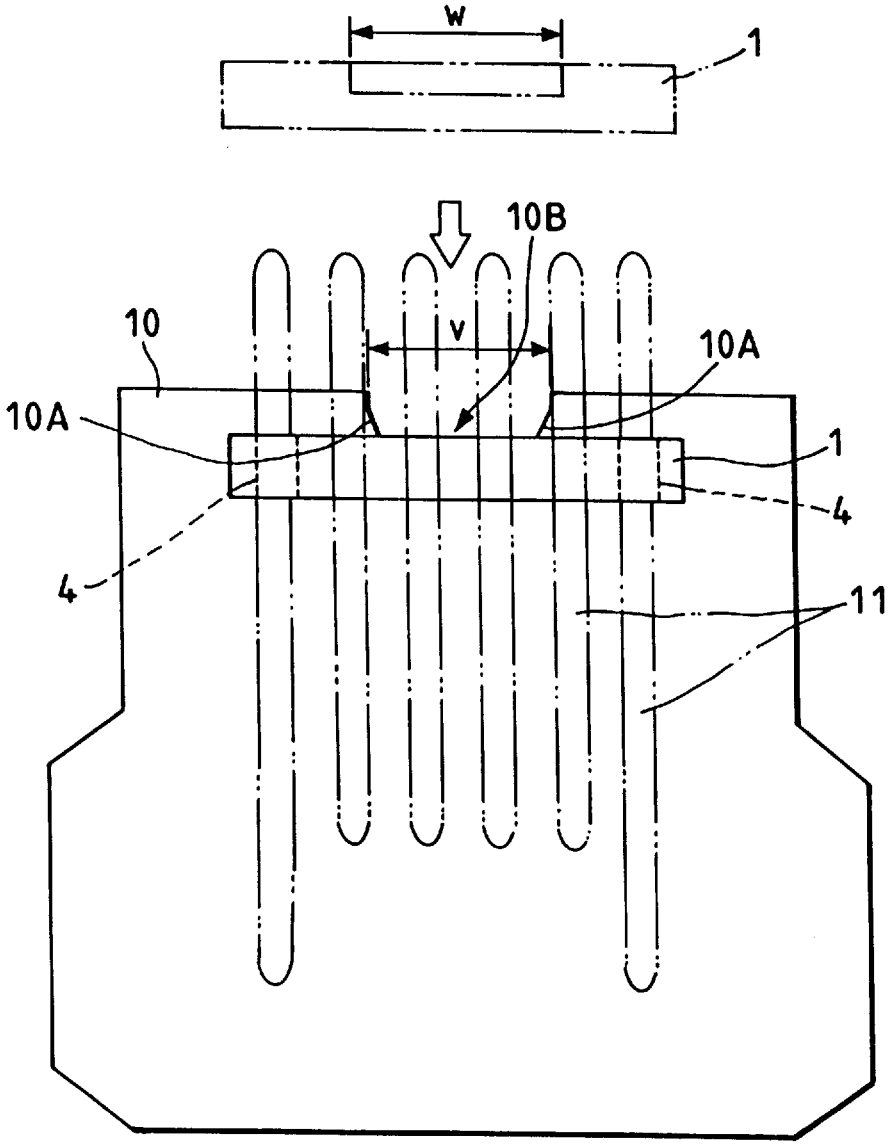
FIGS. 3, 4 and 5 are a front view, a side view and a plan view, respectively, illustrating the terminal arranging board shown in FIG. 1 which is coupled to a connector housing.
Figure 4:
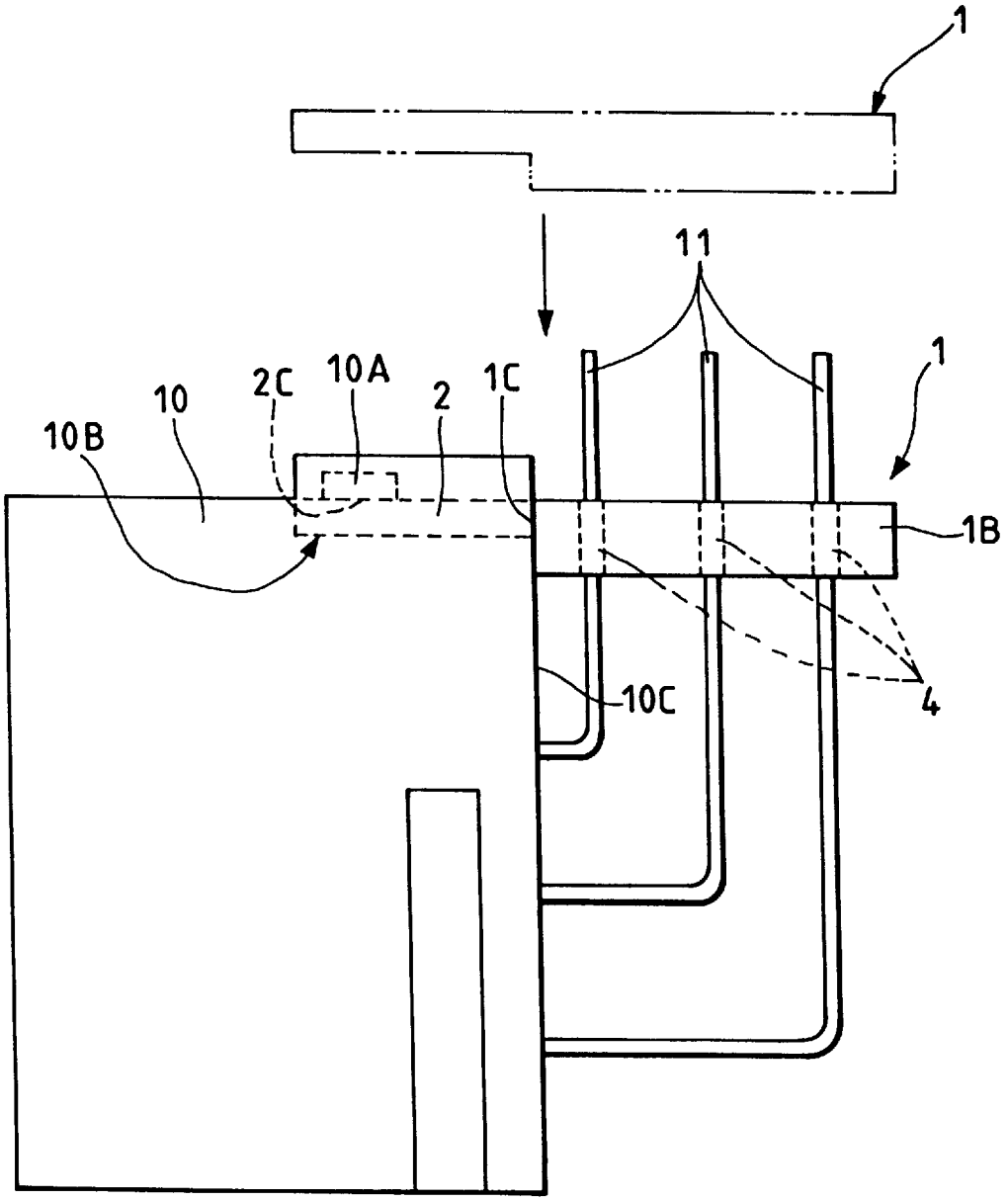
Figure 5:
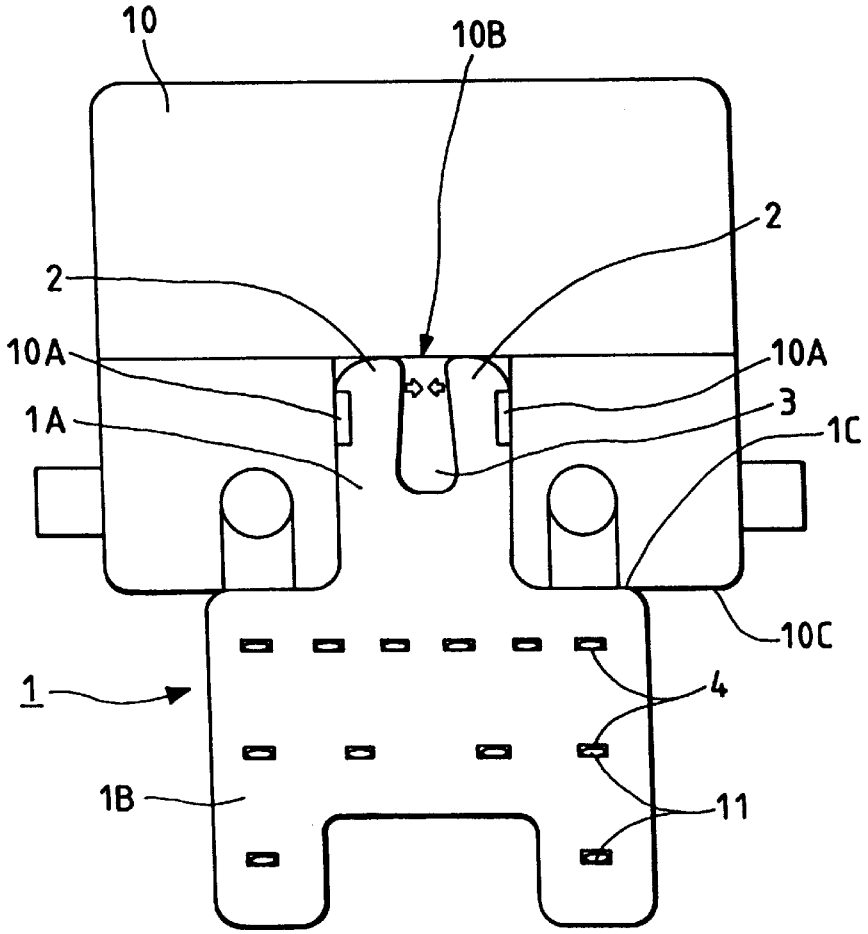
Figure 6:
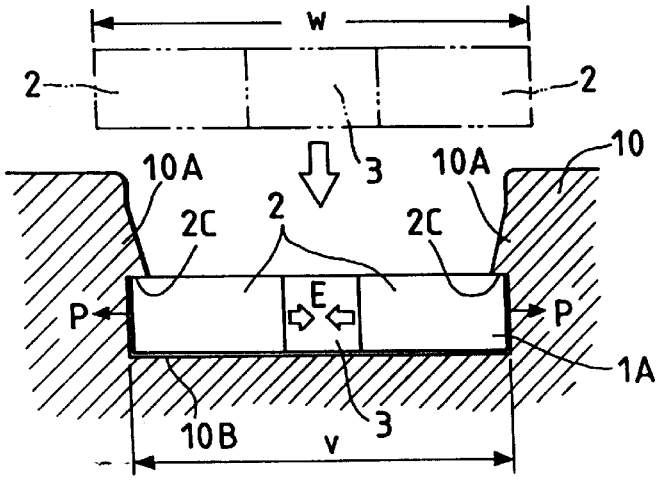
FIG. 6 is an explanatory diagram showing the terminal arranging board which is engaged with an engaging recess formed in the connector housing.
Figure 7:
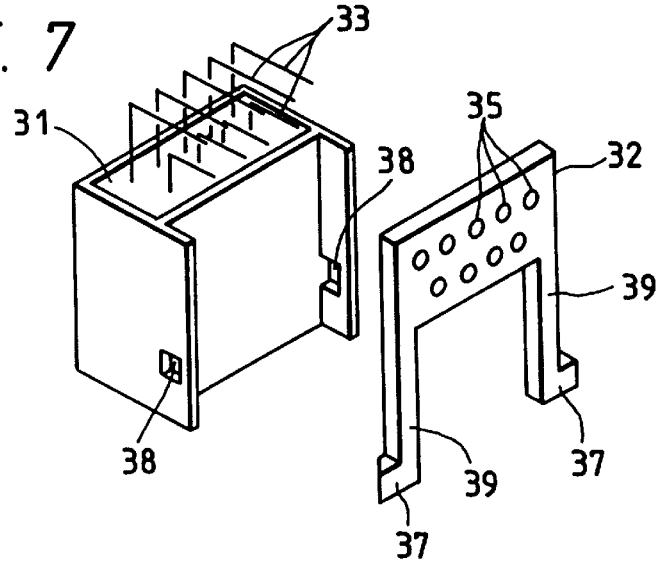
PRIOR ART FIG. 7
FIG. 7 is a perspective view showing a conventional terminal arranging board.
Figure 8:
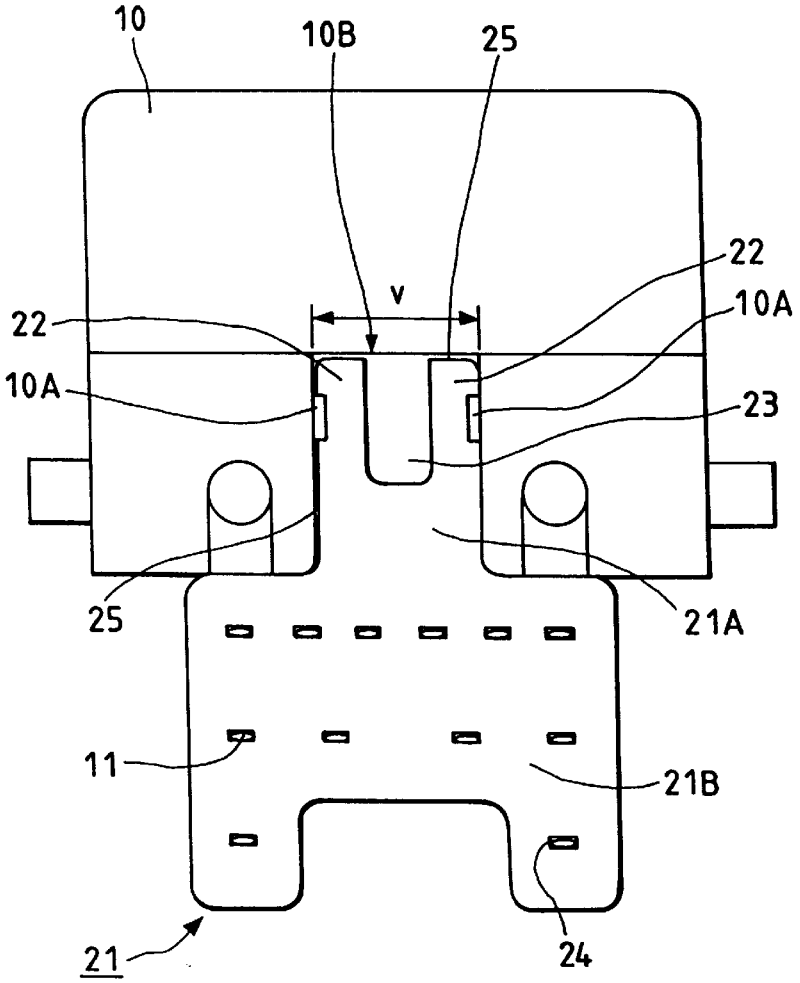
FIG. 8 is a plan view showing a terminal arranging board of a first embodiment of the present invention locked to a connector housing.

A terminal arranging board for a circuit board connector, which constitutes a preferred embodiment of the invention, will be described with reference to FIGS. 1–6 and 8. FIG. 1 is a plan view of the terminal arranging board according to a second embodiment of the present invention. FIG. 2 is a view taken in the direction of the arrow X in FIG. 1. FIGS. 3, 4 and 5 are a front view, a side view and a plan view, respectively, illustrating the terminal arranging board shown in FIG. 1 which is coupled to a connector housing. FIG. 6 is an explanatory diagram showing the terminal arranging board which is engaged with an engaging recess. FIG. 8 is a plan view showing a second embodiment of a terminal arranging board of the present invention locked to a connector housing.

As shown in FIG. 8 of one embodiment of the present invention, the terminal arranging board 21, as shown in FIG. 8, comprises: an inserting section 21A which is inserted into a connector housing 10; and a terminal arranging section 21B which is integral with the inserting section 21A. The front end portion of the inserting section 21A is formed into a pair of engaging pieces 22 which are confronted with each other with a space 23 between them. The terminal arranging section 21B has terminal inserting holes 24 into which connecting terminals led out of the connector housing 10 are inserted. The terminal arranging board 21 is engaged with the connector housing 10 from above while the connecting terminals are being inserted into the terminal inserting holes 24.

The connector housing 10 has an engaging recess 10B in one wall at the center. The engaging recess 10B is a rectangular recess having a width v, and its right and left surfaces have locking protrusions 10A. On the other hand, the width of the inserting section 21A is slightly smaller than the width v of the engaging recess 10B so that the former 21A can be inserted into the latter 10B with ease.

The inserting section 21A of the terminal arranging board 21 is inserted into the engaging recess 10B of the connector housing 10 from above. In this operation, the engaging pieces 22 are slid down the sloped surfaces of the locking protrusions 10A while being elastically deformed towards the space 23. Simultaneously, when the inserting pieces 22 reach the bottom of the engaging recess 10B, the upper surfaces of the engaging pieces 22 are locked by the lower surfaces of the locking protrusions 10A.

Thus, the engaging pieces 22 have been buried in the connector housing. Hence, the engaging pieces 22 are scarcely affected by external force, for instance, during transportation.

As shown in FIGS. 1 and 2 of another embodiment of the present invention, the terminal arranging board 1 of the invention is made of elastically deformable material such as thermoplastic-material, and it includes: a terminal arranging section 1B having a plurality of terminal inserting holes 4; and a lock arm section 1A extended from the terminal arranging section 1B. In order to effectively align connecting terminals which are inserted into the terminal inserting holes 4, the terminal arranging board 1 is made sufficiently large in thickness.

The connecting terminals are bent at right angles and held aligned in a connector housing (described later). The connecting terminals thus arranged are inserted into the terminal inserting holes 4 formed in the terminal arranging section 1B. The end portion of the lock arm section 1A is formed into a pair of engaging pieces 2 which are confronted with each other with a space 3 between them. The outer side portions of the pair of engaging pieces 2 are formed into expanded portions 2A which have tapered surfaces 2C, respectively. The distance w between the outer edges of the expanded portions 2A is larger than the width w of an engaging recess 10B (described later) (cf. FIG. 3).

The terminal arranging board is coupled to the circuit board connector as follows:

As shown in FIGS. 3 through 5, the lock arm section 1A of the terminal arranging board 1 is inserted into the engaging recess 10B of the connector housing 10 from above while the connecting terminals 11, which have been led out of the connector housing 10 and bent at right angles, are being inserted into the terminal inserting holes 4 of the terminal arranging board 1.

The engaging recess 10B is a rectangular recess having a width of v, and has a pair of locking protrusions 10A respectively on its right and left surfaces. The locking protrusions 10A have sloped surfaces the distance between which are smaller towards the bottom of the engaging recess 10B.

The lock arm section 1A of the terminal arranging board 1 is inserted into the engaging recess 10B of the connector housing 10 from above. In this operation, the engaging pieces 2 are moved down the sloped surfaces of the locking protrusions 10A, respectively; so that the engaging pieces 2 are elastically deformed towards the space 3. That is, the lock arm section 1A is moved over the sloped surfaces of the locking protrusion 10A , and finally the engaging pieces 2 reach the bottom of the engaging recess 10B while the tapered surfaces 2C of the engaging pieces 2 are locked by the lower surfaces of the locking protrusions 10A, respectively.

That is, being locked by the locking protrusions 10A in the above-described manner, the engaging pieces 2 are held in the engaging recess 10B, and therefore the engaging pieces 2 are scarcely affected by external force, for instance, during transportation. Thus, the lock arm section 1A including the expanded portions 2A has been fixedly held in place in the engaging recess 10B.

As shown in FIG. 6, the width v of the engaging recess 10B is smaller than the distance w between the outer edges of the engaging pieces 2. Hence, the engaging pieces 2 of the lock arm 1A thus locked are kept urged (elastically deformed) towards each other or in the directions of the arrows E at all times. As a result, the restoring forces of the engaging pieces 2 of the lock arm 1A, namely stresses P, act to cause the engaging pieces 2 to push the right and left surfaces of the engaging recess 10B.

As shown in FIGS. 4 and 5, each of the expanded portions 2A of the engaging pieces 2 is spread outwardly having a tapered side surface 2C. The components of the restoring forces act longitudinally of the engaging pieces 2, so that the terminal arranging board 1 is pushed against the surface 10C of the side wall of the connector housing 10. That is, when the terminal arranging board 1 is coupled to the connector housing 10, the engaging pieces 2 are pushed against the right and left surfaces of the engaging recess 10B while the front end 1C of the terminal arranging section 1B is pushed against the surface 10C of the side wall of the connector housing 10 through which the connecting terminals are led out.

Hence, no gap is formed between the right and left surfaces of the engaging recess 10B and the lock arm section 1A, and the terminal arranging board 1 never moves while aligning the connecting terminals 11; that is, it is positively locked to the connector housing.

While the preferred embodiments have been described, it should be noted that the invention is not limited thereto or thereby. That is, in the above-described embodiments, the tapered surface of each of the expanded portions of the engaging pieces is straight; however, the same effect may be obtained by modifying the tapered surface into one which is moderately outwardly curved or inwardly curved.

In the above-described embodiments, both of the engaging pieces have expanded portions. However, the terminal arranging board may be so modified that only one of the engaging pieces has the expanded portion. It goes without saying that the modification provides sufficiently high effects.

As was described above, in the terminal arranging board according to the invention, the outer side portion of at least one of the engaging pieces of the lock arm section is formed into the expanded portion having the tapered surface. Hence, when the terminal arranging board is coupled to the connector housing, the engaging piece is pushed into the engaging recess of the connector housing while being elastically deformed. In this operation, the engaging piece is bent inwardly. Hence, the restoring force of the engaging piece acts so that the engaging pieces are pushed against the side surfaces of the engaging recess while the terminal arranging board is pushed against the side wall of the connector housing.

Hence, the terminal arranging board is prevented from coming off the connector housing and from playing. Therefore, with the terminal arranging board of the invention, the connecting terminals are held aligned at all times, and the circuit board connector is improved in quality and in reliability, and can be mounted on the printed circuit board with high work efficiency.

What is claimed is:

1. A terminal arranging board which is receivable in a connector housing, comprising:

a terminal arranging portion having a plurality of terminal inserting holes;

a lock arm portion for retaining said terminal arranging board in said connector housing, said lock arm portion extending from said terminal arranging portion, and having a pair of flexible engaging pieces engageable with an engaging recess formed in a connector housing, said engaging recess having a pair of opposed side surfaces, each of said engaging pieces comprising an outer side portion;

said engaging pieces being urged against said side surfaces of said engaging recess when said terminal arranging board is engaged with said engaging recess; and wherein said lock arm portion is completely contained within said engaging recess when said terminal arranging board is engaged with said engaging recess and, wherein a distance between said outer side portions of said engaging pieces in an undeformed state is larger than a width of said engaging recess formed in said connector housing and equal to said width when said lock arm portion is engaged with said engaging recess.

2. A terminal arranging board as claimed in claim 1, wherein at least one of said engaging pieces further comprises an expanded portion having a tapered surface disposed on said outer side portion.

3. An electrical connector, comprising:

a connector housing comprising an engaging recess, said engaging recess further comprising a pair of opposed side surfaces and a pair of locking protrusions respectively disposed on said side surfaces; and a terminal arranging board which is receivable in said connector housing, comprising a terminal arranging portion having a plurality of terminal inserting holes, and a lock arm portion for retaining said terminal arranging board in said connector housing, said lock arm portion extending from said terminal arranging portion, and having a pair of flexible engaging pieces engageable with said engaging recess, each of said engaging pieces comprising an outer side portion;

wherein a distance between said outer side portions of said engaging pieces in an undeformed state is larger than a width of said engaging recess, said engaging pieces being urged against said side surfaces of said engaging recess when said terminal arranging board is engaged with said engaging recess so that said distance is equal to said width;

wherein said locking protrusions retain said lock arm portion in said engaging recess when said terminal arranging board is engaged with said engaging recess; and wherein said lock arm portion is completely contained within said engaging recess when said terminal arranging board is engaged with said engaging recess.

4. An electrical connector as claimed in claim 3, wherein said locking protrusions have sloped surfaces for bending said engaging pieces inwardly upon insertion of said lock arm portion into said engaging recess.

5. An electrical connector as claimed in claim 3, wherein at least one of said engaging pieces further comprises an expanded portion having a tapered surface disposed on said outer side portion.

6. A terminal arranging board which is receivable in a connector housing, comprising:

a terminal arranging portion having a plurality of terminal inserting holes; and a lock arm portion extending from said terminal arranging portion, and having a pair of flexible engaging pieces engageable with an engaging recess formed in a connector housing, said engaging recess having a pair of opposed side surfaces, each of said engaging pieces comprising an outer side portion, a distance between said outer side portions being larger than a width of said engaging recess, wherein at least one of said engaging pieces further comprises an expanded portion having a tapered surface disposed on said outer side portion, wherein said engaging pieces are urged against said side surfaces of said engaging recess when said terminal arranging board is engaged with said engaging recess so that said distance between said outer side portions is equal to said width.

7. An electrical connector, comprising:

a connector housing comprising an engaging recess, said engaging recess comprising a pair of opposed side surfaces and a pair of locking protrusions respectively disposed on said side surfaces; and a terminal arranging board which is receivable in said connector housing, comprising a terminal arranging portion having a plurality of terminal inserting holes, and a lock arm portion extending from said terminal arranging portion, said lock arm portion having a pair of flexible engaging pieces engageable with said engaging recess, each of said engaging pieces comprising an outer side portion wherein at least one of said engaging pieces further comprises an expanded portion having a tapered surface disposed on said outer side portion, and wherein said locking protrusions retain said lock arm portion in said engaging recess when said terminal arranging board is engaged with said engaging recess, and wherein a distance between said outer side portions of said engaging pieces, in an undeformed state, is larger than a width of said engaging recess, so that when said lock arm portion is retained in said engaging recess, said distance of said outer side portions is equal to said width of said engaging recess.

* * * * *